United States Patent [19]

Zachman

[11] 3,978,744

[45] Sept. 7, 1976

[54] DIAMOND WIRE DRAWING DIE BLANKS AND METHODS OF MAKING THE SAME

[75] Inventor: Neil J. Zachman, Kokomo, Ind.

[73] Assignee: Cabot Corporation, Kokomo, Ind.

[22] Filed: Mar. 17, 1975

[21] Appl. No.: 559,122

[52] U.S. Cl. ..... 76/107 A

[51] Int. Cl.[2] ..... B21K 5/20; B22F 7/08

[58] Field of Search ..... 76/107 R, 107 A, 101 B, 76/DIG. 12; 72/467; 29/420, DIG. 31

[56] References Cited

UNITED STATES PATENTS 2,171,323 8/1939 Wyland ..... 76/107 A

FOREIGN PATENTS OR APPLICATIONS 667,809 3/1952 United Kingdom ..... 76/107 A

*Primary Examiner*—Al Lawrence Smith
*Assistant Examiner*—James G. Smith
*Attorney, Agent, or Firm*—Buell, Blenko & Ziesenheim

[57] ABSTRACT

A diamond wire drawing die blank and method for making the same are provided in which a diamond die blank is formed by metering about one half of a metal powder required to form a shroud around a diamond into a die cavity, partially compressing said one half while forming a central conical depression in said powder, placing a diamond in the formed conical cavity, adding the remaining metal powder to the mold over the die and first compressed half, compressing the metal powder around the diamond and sintering said powder compact.

8 Claims, 5 Drawing Figures

DIAMOND WIRE DRAWING DIE BLANKS AND METHODS OF MAKING THE SAME

This application relates to diamond wire drawing die blanks and methods of making the same and particularly to a diamond wire drawing die produced as a sintered powdered metal compact.

The use of diamonds supported by a metal or carbide backing or shroud for wire drawing is not new. Diamonds have, for exaample, been embedded in a cast iron shroud and set in a mounting of 18-8 nichromium steel (U.S. Pat. No. 2,689,641), in a forged metal shroud of aluminum, bronze or monel (U.S. Pat. No. 2,866,364) in a metal bonded carbide jacket (U.S. Pat. No. 3,831,428) as well as in other mechanical ways. Unfortunately, the methods used in the past have resulted in a relatively high rate of diamond loss through breakage and off-center placement during forming of the die. Part of these losses are due to the fact that the die is not under uniform spherical radial compression design to offset in part the outward compression of the wire being drawn so that the diamond lacks adequate support. In addition, part of the losses are due to the diamond being forced off center during the shrouding or backing operation so that on drilling the diamond, the hole is off center.

The die of the present invention and the method here described eliminates both these problems and provides diamond wire drawing dies which are uniformly centered and uniformly supported.

In the present invention there is provided a diamond die blank comprising a diamond centered on the axis of a metal powder shroud consolidated to substantially full density and having at least one external axial conical cavity. The die blank is made by metering one half of the metal powder required to form the shroud into a powder metal die cavity, partially compacting the metal powder, forming a central conical shaped depression in said compacted powder metal, placing a diamond in said cavity, metering the remaining metal powder into the die cavity over the diamond, compressing the added metal powder and said one half of metal powder, forming an axial conical cavity in the top of said formed powder and sintering said powder compact. Preferably, the metal powder is a high strength metal powder such as *Stellite alloys No. 3, No. 6, No. 589, No. 208, No. 19 or the like. The preferred metal powder is Stellite alloy No. 6. The metal powder is preferably compacted in a powder metal die having upper and lower punches, each with a conical shaped axial protrusion which forms both the conical depression for receiving the diamond and conical external axial depressions at opposite sides of the die blank. Preferably the first one half of the metal powder is compacted to 30% to 50% of the pressure required to produce the finished wire drawing die compact prior to adding the second half of the powder. The final compact is sintered in the sintering range of the alloy powder being used.

*T. M. of Cabot Corp.

In the foregoing general description certain objects, purposes and advantages of this invention have been set out. Other objects, purposes and advantages of this invention will be apparent from the following description and the accompanying drawings in which.

Figure 1:
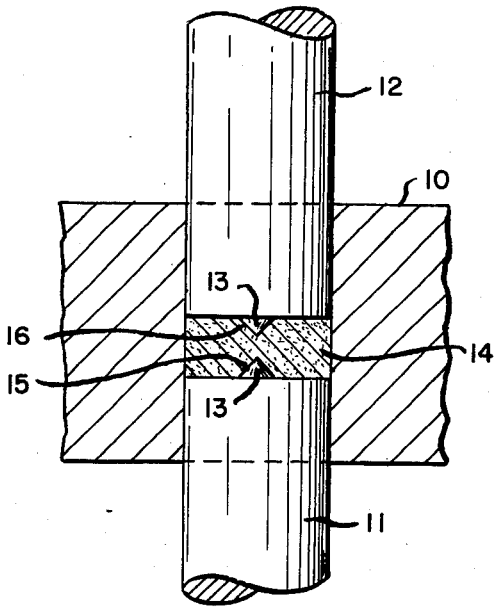
FIG. 1 is a fragmentary section through a powder metal die showing one half of a die blank partially compressed according to this invention.
Figure 2:
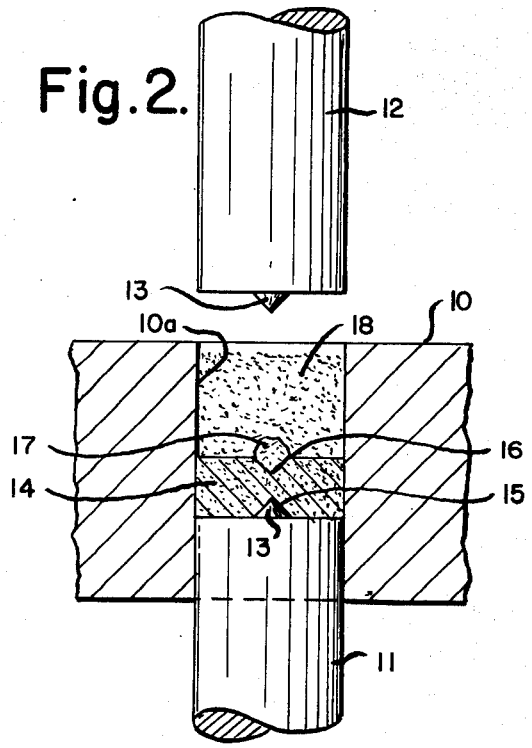
FIG. 2 is a fragmentary section of the die of FIG. 1 with a diamond and remaining metal powder in place in the die.
Figure 3:
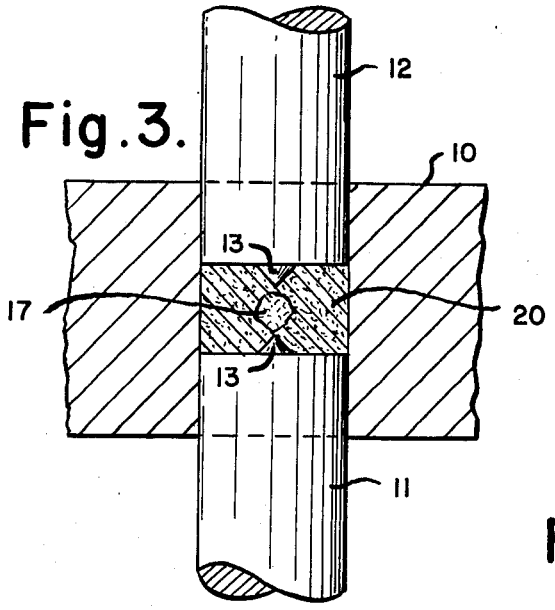
FIG. 3 is a fragmentary section of the die of FIG. 1 showing the final compression of metal powder about the central diamond.
Figure 4:
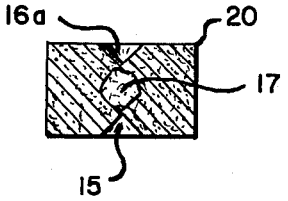
FIG. 4 is a section through the final wire drawing die blank.
Figure 5:
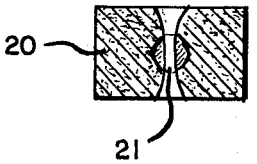
FIG. 5 is a section through a completed wire drawing die.

Referring to the drawings there is illustrated a circular powder metal die 10 with lower punch 11 and upper punch 12. Each of the lower 11 and upper 12 punches is provided with a central conical projection 13 on the axis of the die opening 10*a*. A first half portion 14 of the metal powder to be used in forming the wire drawing die is compressed within die 10 between upper and lower punches 11 and 12, forming axial conical cavities 15 and 16. The pressure used to compress this first half is about 30% to 50% of the final pressure used in forming the die. A diamond 17 is placed in the upper cavity 16 of the partially compressed metal powder 14 and the remaining metal powder 18 is poured over it. The two metal powder portions 14 and 18 with the diamond 17 located in cavity 16 are compressed to form the final die blank 20, having external conical cavities 15 and 16*a* at the bottom and top respectively of the die blank. These external conical cavities are in alignment with the center of diamond 17 and act as a guide for drilling the axial hole 21 in the final finished die. After compression to final shape the die blank 20 is pressure sintered in the sintering range of the alloy used, cooled and drilled.

In the foregoing specification certain preferred embodiment and practices of this invention have been set out, however, it will be understood that this invention may be otherwise embodied within the scope of the following claims.

I claim:

1. The method of forming diamond wire drawing die blanks comprising the steps of a. metering substantially one half of a metal powder required to form a shroud around a diamond into a die cavity for receiving powder metal;

b. partially compressing said substantially one half of the metal powder into a flat member of substantially uniform thickness in said die cavity;

c. simultaneous with step (b) forming a central conical shaped depression in the top surface of said compacted powder metal;

d. placing a diamond in said conical depression without removing the compacted powder metal from said die cavity;

e. adding the remaining metal powder required to form a shroud into said die cavity over the diamond and said partially compressed one half without removing the compacted powder metal from said die cavity;

f. compressing said remaining metal powder and said substantially one half of metal powder around said diamond in said die cavity; and g. sintering said metal powder compact.

2. A method as claimed in claim 1 wherein at least one external axial conical depression is formed in the final compressed powder.

3. A method as claimed in claim 1 wherein the metal powder is compressed in step (b) under about 30% to 50% of the pressure needed to form the final die.

4. A method as claimed in claim 1 wherein an external conical axial depression is formed at each end of said blank during final compression.

5. A method as claimed in claim 1 wherein the metal powder is an alloy selected from the group consisting of Stellite alloys No. 6, No. 3, No. 589, No. 208 and No. 19.

6. A method as claimed in claim 1 wherein the metal powder is Stellite alloy No. 6.

7. A method as claimed in claim 1 wherein the final compressed blank is pressure sintered to substantially the full density in the sintering range of the alloy used.

8. A method as claimed in claim 1 wherein the metal powder is compressed between punches having axial conical projections.

* * * * *